United States Patent [19]

Shano

[11] Patent Number: 4,889,440

[45] Date of Patent: Dec. 26, 1989

[54] WAX APPLICATOR WITH ELECTRONIC CONTROL

[75] Inventor: Charles L. Shano, Phoenix, Ariz.

[73] Assignee: Lectro Stik Corp., Chicago, Ill.

[21] Appl. No.: 245,950

[22] Filed: Sep. 16, 1988

Related U.S. Application Data

[63] Continuation of Ser. No. 91,437, Aug. 31, 1987, abandoned.

[51] Int. Cl.[4] ..... B05C 17/02; B42C 9/00

[52] U.S. Cl. ..... 401/1; 219/421; 219/425; 222/146.5; 401/208

[58] Field of Search ..... 401/1, 2; 222/146.2, 222/146.5; 219/421, 425, 506, 497, 499; 137/392

[56] References Cited

U.S. PATENT DOCUMENTS

| | | | |
|---|---|---|---|
| 3,103,689 | 9/1963 | Borisof | 15/504 |
| 3,430,816 | 3/1969 | Nadherny et al. | 401/1 |
| 3,485,417 | 12/1969 | Cocks | 222/146.5 X |
| 4,006,895 | 2/1977 | Scholl et al. | 401/2 X |
| 4,032,046 | 6/1977 | Elliott et al. | 401/1 X |
| 4,065,214 | 12/1977 | Daum et al. | 401/2 |
| 4,278,872 | 7/1981 | Koether et al. | 219/506 X |
| 4,413,255 | 11/1983 | Cohen et al. | 219/421 X |
| 4,432,715 | 2/1984 | Ghim | 401/1 X |
| 4,639,611 | 1/1987 | Sticher | 219/497 |
| 4,744,688 | 5/1988 | Silber | 401/1 |
| 4,773,784 | 9/1988 | Mann | 401/1 |

FOREIGN PATENT DOCUMENTS

| | | | |
|---|---|---|---|
| 2518022 | 6/1983 | France | 401/2 |

OTHER PUBLICATIONS

Designing with Operational Amplifiers by J. R. Graeme, pp. 57 & 62, 1977.

Publication entitled Series 662 Disc PTC Thermistors, Mepco/Electra, Inc., Columbia Road, Morristown, NJ 07960, pp. 582 and 583.

*Primary Examiner*—Steven A. Bratlie

*Attorney, Agent, or Firm*—Burmeister, York, Palmatier & Zummer

[57] ABSTRACT

The disclosed roller applicator, for applying a coating of molten wax or the like on paper or the like, has a bowl in which wax is melted and heated to a high working temperature by an electrical heating resistor under the thermal control of a first thermistor, directly in series with the resistor across AC power conductors. The thermistor, when heated to the working temperature, makes a transition between a low resistance state and a disproportionately higher resistance state, for greatly reducing the resistor current. An additional resistor, in parallel with the thermistor, bypasses a small keep-warm current through the heating resistor for maintaining the high working temperature. The increased voltage drop across the thermistor is supplied to one input of an operational amplifier, employed as an electronic switch to energize a first LED, signaling "ready". A second thermistor, positioned so that the degree of immersion thereof in the molten wax decreases as the wax level drops, cools off and makes a transition between high resistance and low resistance states. This transition is translated into a magnitude change of electrical pulses supplied to a second operational amplifier for energizing a second LED, indicating "low wax", but such energization is initially disabled by a nonconductive series transistor, which is later rendered conductive by the output of the first operational amplifier. A third LED is energized whenever the electrical power is on.

15 Claims, 5 Drawing Sheets

WAX APPLICATOR WITH ELECTRONIC CONTROL

This application is a continuation of the applicant's copending application, Ser. No. 091,437 filed Aug. 31, 1987, now abandoned.

FIELD OF THE INVENTION

This invention relates to a new and improved roller applicator for applying molten wax or other similar materials to a desired surface, such as a sheet of paper or other thin material, usually for the purpose of utilizing the wax as an adhesive to fasten the paper or other thin material to another surface, such as a backing sheet, a wall surface, a window or the like.

BACKGROUND OF THE INVENTION

In certain aspects, the present invention may be regarded as an improvement over the ROLLER APPLICATORS disclosed in U.S. Pat. No. 3,103,689, issued Sep. 17, 1963 to Bernard Borisof. Such patent discloses a roller applicator comprising a body including a bowl for receiving wax or the like to be melted and maintained in a molten state. The molten wax is supplied to an applicator roller which is rotatably mounted on a lower portion of the bowl. The roller acts as a closure for an opening formed in the lower portion of the bowl, so that the molten wax flows through the opening to the roller. An appropriate seal is provided around the opening, between the roller and the bowl, to permit rotation of the roller while preventing any leakage of molten wax. An electrical resistance heating element is provided in the bowl for melting the wax and maintaining it in a molten state. The heating element also heats the roller so that the wax remains molten on the surface of the roller. Electrical power is supplied to the heating element by an electrical power cord which may be plugged into an electrical outlet, adapted to supply electrical power, usually at about 120 volts, 60 Hertz alternating current.

The wax applicator of the above mentioned Borisof patent has a convenient handle, projecting from the bowl, whereby the user may apply a stripe of molten wax to the desired paper or other surface by pressing the roller against the desired surface and causing the roller to roll along such surface. The roller receives the molten wax from the bowl and transfers the wax to the desired surface, where the wax solidifies and provides an adhesive coating, whereby the paper or other material may be adhered to another surface, which may be on another piece of paper, a wall, a window or the like.

In the wax applicator of the Borisof patent, the electrical resistance heating element is energized continuously with electrical power. The wattage of the heating element is selected so that the wax will be melted, without too much delay, and will be maintained in a molten state, but will not be excessively overheated during normal service, when the wax applicator is used with a fair degree of frequency. The selection of the wattage must necessarily be a compromise between the conflicting problems of overly slow melting of the wax, if the wattage is too low, and overheating of the wax, if the wattage is too great. If the wattage is selected on the low side, to prevent overheating of the molten wax, the initial heating of the wax will be overly slow, involving an inconvenient delay. If the wattage is selected on the high side, to achieve quicker initial melting of the wax, the molten wax may be overheated sufficiently to scorch or otherwise damage the molten wax. Overheating may cause the wax to become discolored or darkened.

SUMMARY OF THE INVENTION

One object of the present invention is to provide a new and improved wax applicator in which the energization of the electrical resistance heating element is automatically temperature controlled, so that the heating element will quickly melt the wax and maintain it in a molten state at a substantially stable temperature, but without overheating the wax.

Another object is to provide a new and improved wax applicator having an indicator to show that the wax has been heated to its operating temperature, at which the wax is molten, so that the wax applicator is ready for use.

A further object is to provide a new and improved wax applicator having an electrically operable indicator which shows that the level of the molten wax has dropped to such an extent that additional wax should be placed in the bowl of the applicator.

Another object is to provide a new and improved wax applicator having a further indicator to show that energizing electrical power is being supplied to the applicator.

A further object is to provide such a new and improved wax applicator which is highly compact, reliable and efficient, yet is low in cost.

To achieve these and other objects, the present invention may provide a wax applicator for applying molten wax to a desired surface, the applicator comprising a body including a bowl for receiving wax to be melted and maintained in a molten state, an applicator roller for receiving the molten wax from the bowl and applying the wax to the desired surface, the bowl having a lower portion with an opening therein through which the wax flows from the bowl to the roller, means for rotatably mounting the roller on the lower portion with the roller forming a closure for the opening, an electrical resistance heating element for melting the wax in the bowl and maintaining the wax in a molten state, and an electrical circuit for energizing and controlling the heating element, the circuit including a thermal control device in the bowl and connected in the circuit with the heating element for initially supplying full electrical current to the heating element and subsequently at least partially reducing the electrical current as a thermal response to a high wax temperature sufficient to maintain the wax in a molten state.

The thermal control device preferably comprises a thermistor having a low electrical resistance at room temperatures and a disproportionately higher electrical resistance at the high wax temperature for greatly reducing the electrical current supplied to the heating element.

The electrical circuit preferably includes means for connecting the thermistor in series with the electrical resistance heating element, and means for supplying electrical power to the circuit.

The wax applicator preferably includes a heat sink member positioned in the bowl in close proximity with the roller, the heating element and the thermistor being mounted on the heat sink member and being positioned for immersion in the molten wax in the bowl.

The electrical circuit preferably comprises a light emitting indicator device, and indicator control means connected to the thermal control device for energizing the indicator device in response to the thermal response of the thermal control device.

As indicated above, the thermistor has a low electrical resistance at room temperatures and a disproportionately higher electrical resistance at the high wax temperature for greatly reducing the electrical current supplied to the heating element, whereby a greatly increased voltage drop is produced across the thermistor by its thermal response to the high wax temperature, the indicator control means being operable in response to the greatly increased voltage drop for energizing the indicator device.

The light emitting indicator device preferably comprises a light emitting diode, while the indicator control means may comprise electronic switching means for energizing the light emitting diode in response to the greatly increased voltage drop.

The electronic switching means may comprise an operational amplifier having an output connected to the light emitting diode, and an input with means for receiving the greatly increased voltage drop from the thermistor.

The wax applicator preferably comprises a second thermal control device positioned in the bowl at a level to establish the minimum desired molten wax level, the second thermal control device being subjected to the high wax temperature when immersed in the molten wax while being subjected to a lower temperature when not fully immersed in the molten wax, the second thermal control device producing an electrical change in response to the lower temperature. The wax applicator also preferably comprises a second light emitting indicator device, and a second electrical control circuit including second indicator control means connected between the second thermal control device and the second light emitting indicator device for energizing the second light emitting indicator device in response to the electrical change of the second thermal control device, whereby the second light emitting indicator device shows that wax should be added to the bowl to maintain the minimum desired molten wax level.

The wax applicator preferably comprises third control means forming a control connection between the first thermal control device and the second light emitting indicator device for initially disabling the energization of the second light emitting indicator device and subsequently enabling the energization thereof in response to the thermal response of the first thermal control device produced by the high wax temperature.

The second thermal control device preferably comprises a second thermistor having a sharply lower electrical resistance at the lower temperature when not fully immersed in the molten wax than at the high wax temperature, the second indicator control means including means for translating the sharply lower electrical resistance to a changed electrical signal, and means responsive to the changed electrical signal for energizing the second light emitting indicator device.

The second light emitting indicator device preferably comprises a second light emitting diode, while the second indicator control means may comprise second electronic switching means for energizing the second light emitting diode in response to the changed electrical signal.

The wax applicator preferably includes third control means forming a control link between the first thermistor and the second light emitting diode for initially disabling the energization of the second light emitting diode and subsequently enabling the energization thereof in response to the greatly increased voltage drop produced across the first thermistor by the high wax temperature.

The third control means may comprise a third electronic switching device having first and second control connections to the first thermistor and the second electronic switching device.

The third electronic switching device preferably comprises a transistor having first and second inputs connected to the first and second control connections.

The second light emitting indicator device preferably comprises a second light emitting diode, while the second indicator control means preferably comprises a second operational amplifier for energizing the second light emitting diode in response to the changed electrical signal.

The circuitry for the wax applicator preferably includes bias source means for producing a substantially steady unidirectional bias voltage. The first operational amplifier preferably has a first bias input for receiving the bias voltage, and a first control input having first control link means to the first thermistor. The second operational amplifier preferably has a second bias input for receiving the bias voltage, and a second control input having second control link means to the second thermistor.

The second control link means may comprise circuit means for supplying the changed electrical signal in the form of changing electrical pulses which progressively change the duty cycle of the second operational amplifier as the temperature of the second thermistor is changed from the high wax temperature to the lower temperature when the second thermistor is not fully immersed in the molten wax, whereby the second light emitting diode is progressively energized as the level of the molten wax drops to change the degree of immersion of the second thermistor.

The second operational amplifier preferably has an output circuit including the second light emitting diode and a transistor, which has an input circuit connected to the first thermistor for initially disabling the energization of the second light emitting diode and subsequently enabling the energization thereof in response to the greatly increased voltage drop produced across the first thermistor by the high wax temperature, the actual energization of the second light emitting diode being produced by the second operational amplifier in response to the changed electrical signal produced when the second thermistor is not fully immersed in the molten wax.

The wax applicator preferably has an additional light emitting diode to show that the applicator is energized with electrical power.

BRIEF DESCRIPTION OF THE DRAWINGS

Further objects, advantages and features of the present invention will appear from the following detailed description, taken with the accompanying drawings, in which.

DETAILED DESCRIPTION OF ILLUSTRATIVE EMBODIMENTS

As just indicated, the drawings illustrate a new and improved roller applicator 20 for applying a coating 22 of molten wax or other similar materials to a desired surface 24, such as a sheet of paper or other thin material, usually for the purpose of utilizing the wax as an adhesive to fasten the paper or other thin material to another surface, such as a backing sheet, a wall surface, a window or the like. The applicator 20 will find other uses. The wax is preferably a microcrystalline wax material, adapted to serve as a pressure sensitive adhesive which will form a firm but separable bond, so that the paper or other thin material can be fastened with an adequate degree of security to a backing or supporting surface, but can be peeled away without damage to the paper or other thin material, so that it can be repositioned in a new location, as needed.

The wax adhesive is in a solid state at room temperatures, but is heated to a molten state in the roller applicator 20, and is in the molten state when applied to the desired surface. However, the wax quickly cools to a solid state and is available for use immediately as a pressure sensitive adhesive.

Figure 1:
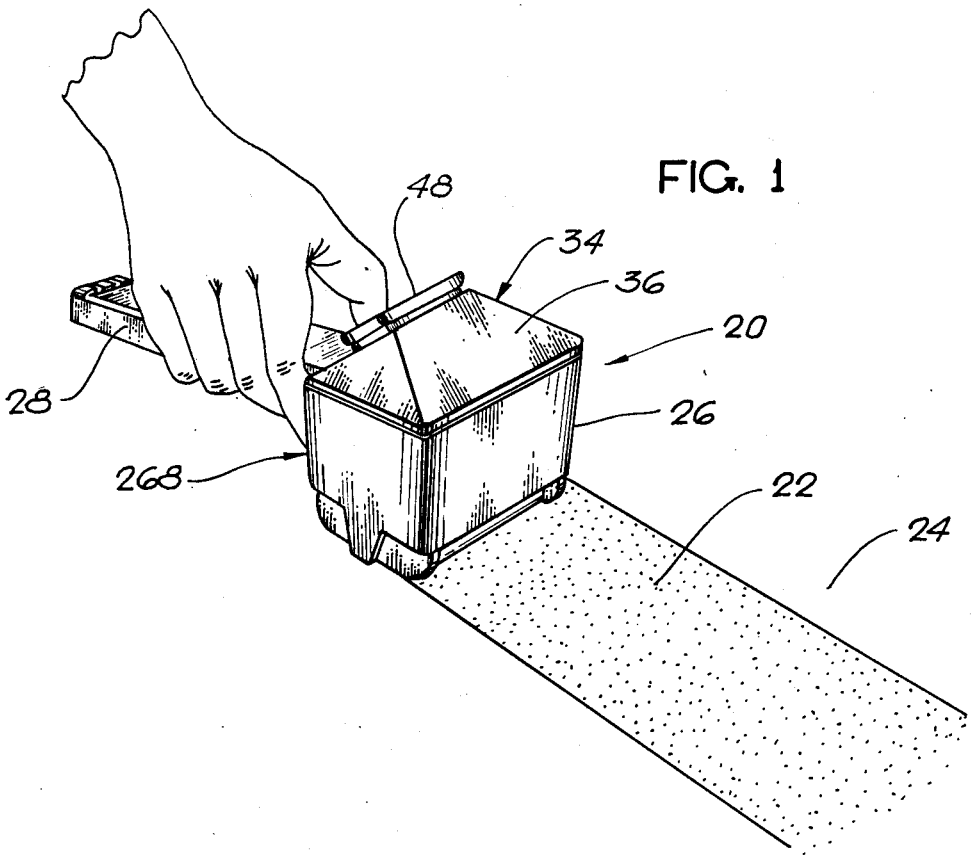
FIG. 1 is a general perspective view of a wax applicator to be described as an illustrative embodiment of the present invention.

The roller applicator 20 comprises a receptacle or bowl 26 adapted to hold a supply of the adhesive wax or other material. The bowl 26 may be made of any suitable material but is preferably molded in one piece from a suitable heat resistant resinous plastic material. As shown, the bowl 26 is generally rectangular in shape. A handle 28 is illustrated as projecting rearwardly from one side of the bowl 26 and is preferably molded in one piece therewith. As shown in FIG. 1, the handle 28 is adapted to be grasped by the operator and used in manipulating the applicator 20.

Figure 4:
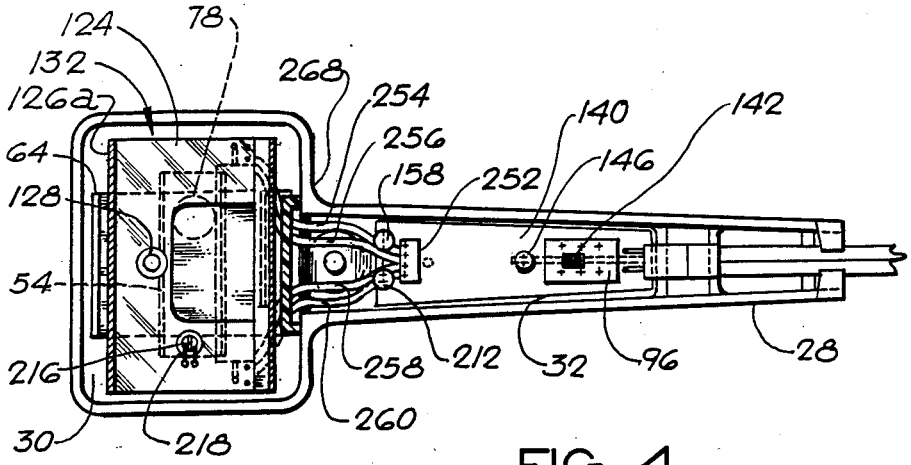
FIG. 4 is a somewhat diagrammatic top plan view of the wax applicator, with the top cover thereof removed, to show some of the interior components.
Figure 5:
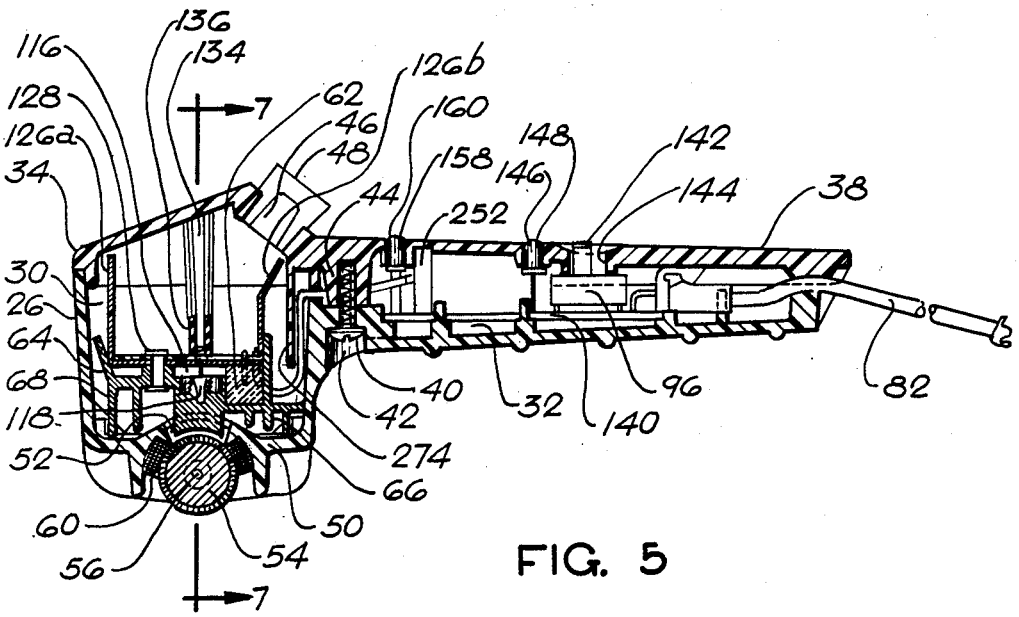
FIG. 5 is a somewhat diagrammatic longitudinal elevational section through the wax applicator, taken generally along the line 5—5 in FIG. 3.

As shown in FIGS. 4 and 5, the bowl 26 is formed with a hollow space 30 therein, adapted to receive the wax initially, in its solid state, and subsequently to hold the molten wax. The handle 28 is also hollow and is fomed with a hollow space 32. As shown in FIGS. 4 and 5, the hollow spaces 30 and 32 open upwardly and are adapted to be closed by a removable cover or closure 34 having a generally rectangular portion 36, for closing the space or cavity 30 in the bowl 26 and an elongated portion 38, for closing the cavity or space 32 in the handle 28. The cover 34 may be made of any suitable material, but preferably is molded in one piece from a heat resistant resinous plastic material. The cover 34 is removably held in place by suitable means, illustrated as comprising a screw 40, insertable through an opening 42 in the underside of the handle 28, and threaded upwardly into a member 44 on the handle closing portion 38 of the cover 34.

Provision is made for inserting small bars or pieces of solid wax into the bowl 26 without removing the cover 34. For this purpose, the bowl closing portion 36 of the cover 34 is formed with an opening 46, adapted to be closed by a removable stopper 48. As shown, the opening 46 and the stopper 48 are generally rectangular in shape. The stopper 48 is preferably made of a soft, compliant resinous plastic material, so that the stopper can be received in the opening 46 with a sealing fit, yet is easy to insert and remove.

Figure 6:
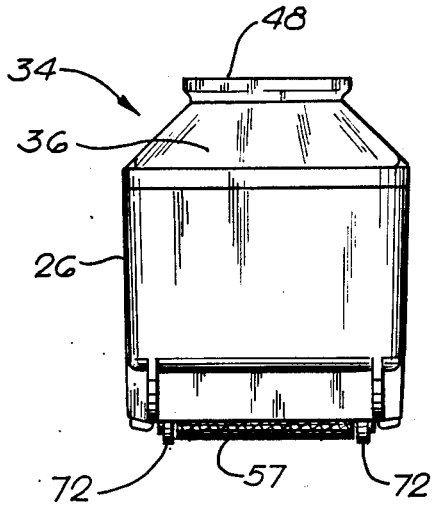
FIG. 6 is a front end elevational view of the wax applicator.
Figure 7:
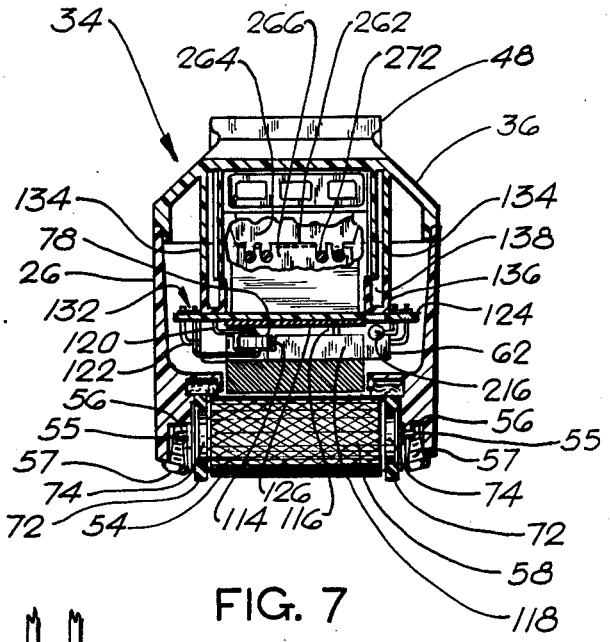
FIG. 7 is a transverse elevational section, taken generally along the line 7—7 in FIG. 5.

The bowl 26 has a lower portion 50 formed with an opening or orifice 52 therein, through which the molten wax flows out of the bowl 26 to a rotatable applicator roller 54, rotatably mounted on the bowl 26, as by means of axle elements 55, preferably formed integrally with the roller 54 and retained in bearing slots 56 in the bowl 26, as by screws 57. The applicator roller 54 may be made of any suitable material, but preferably is made of a highly heat conductive metal, such as aluminum, which may be anodized as a protection against corrosion. As shown in FIGS. 6 and 7, the roller 54 has a cylindrical surface 58 which is pitted with a multiplicity of pits, in a manner similar to knurling, in order that the roller 54 may convey and transfer a rough coating of the wax adhesive 22, to any surface along which the roller 54 is rolled.

The wax applicator 20 comprises means for providing a seal 60 around the orifice 52 and between the roller 54 and the bowl 26, to prevent leakage of molten wax out of the bowl, around the roller 54. The seal 60 makes it possible for the roller 54 to form a complete closure for the orifice 52. The seal 60 may be in the form of a soft resilient pad or packing, made of a heat resistant material, such as silicone foam rubber or the like, preferably faced with a wear-resistant film, such as Teflon. The seal 60 is generally annular in shape, in that it forms a complete generally rectangular ring around the entire orifice 52.

The illustrated roller applicator includes means including an electrical resistance heating element 62 within the bowl 26 for melting the wax therein and maintaining the wax in a molten state. As shown in FIGS. 5 and 7, the bowl 26 also contains means for increasing the heat transfer to the wax, while also increasing the heat transfer from the hating element 62 to the roller 54, so that the roller is heated sufficiently to maintain the wax in a molten state on the roller. Such means are illustrated as comprising a heat sink member 64, disposed in the bowl 26, for conducting heat from the heating element 62 to the wax. The heating element 62 is mounted on the heat sink member 64 and preferably is received in a channel 66 in the upper side thereof. The heat sink member 64 may be made of any suitable material, preferably a highly heat conductive metal, such as aluminum. As shown, the heat sink member 64 has several heat transferring fins 68 thereon, to afford a large heat transferring surface area in contact with the molten wax. The illustrated heat sink member 64 has a large central portion 70, projecting downwardly into close proximity with the roller 54, so as to heat the roller sufficiently to maintain the wax in a molten state on the roller.

Figure 2:
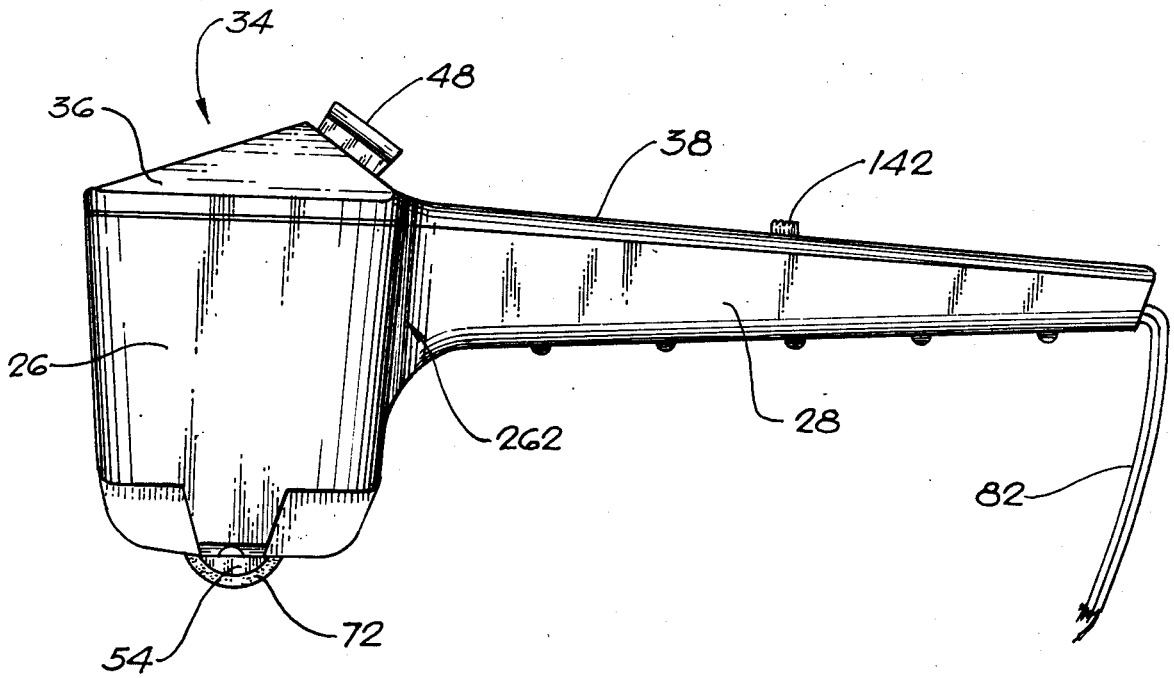
FIG. 2 is a side elevational view of the wax applicator of FIG. 1.

As shown in FIGS. 2 and 6, the roller 54 is fitted with a pair of traction tires 72, preferably made of a soft resilient heat resistant synthetic rubber or rubberlike material, for assisting in causing the roller 54 to rotate when the roller is moved along a surface to which the wax adhesive 22 is to be applied. The traction tires 72 may be in the form of rubber rings, received and retained in grooves 74 formed in the roller 54, near the ends thereof, as shown in FIG. 7.

Figures 9, 10:
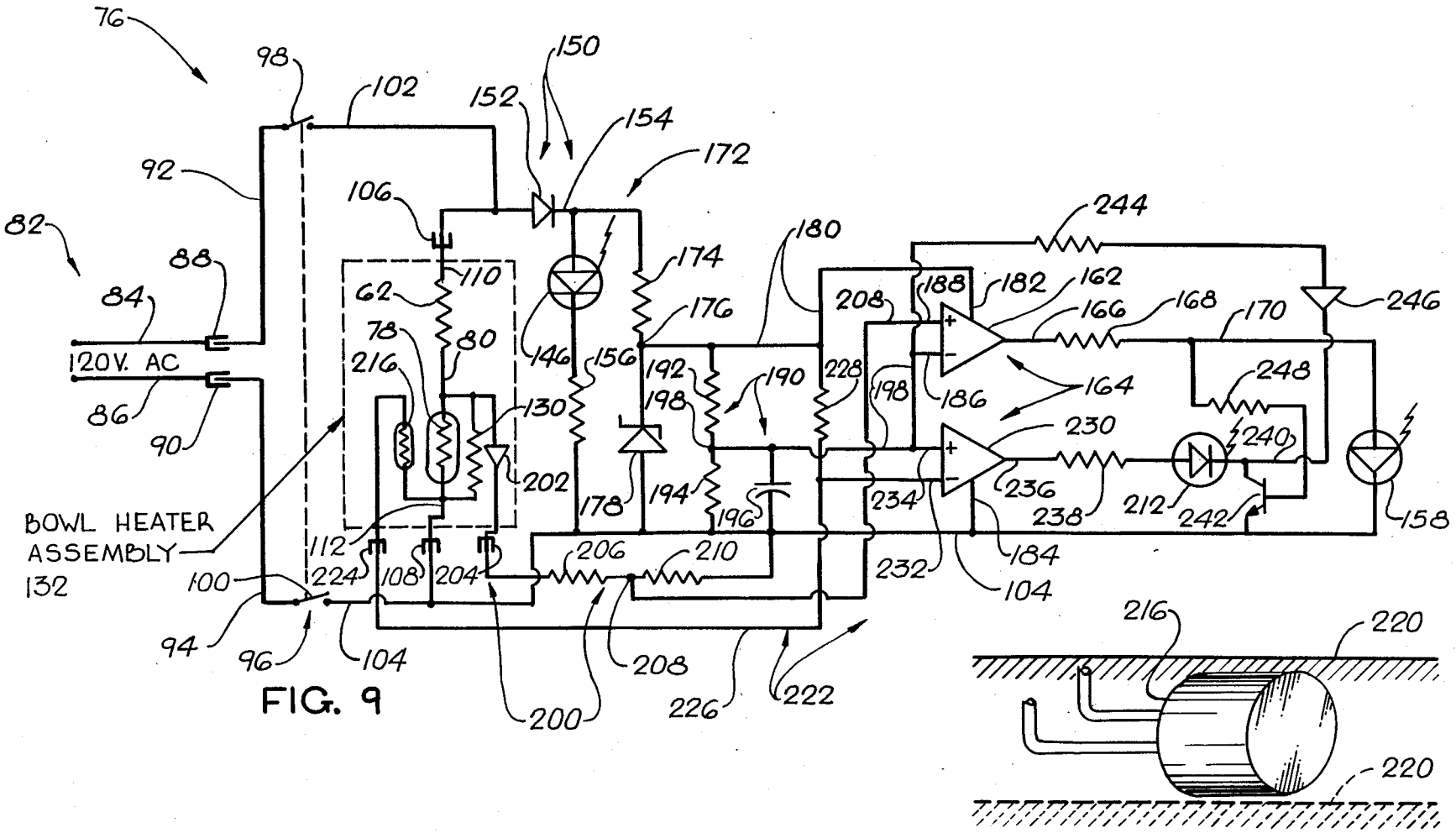
FIG. 9 is a schematic circuit diagram, representing the electronic circuitry of the wax applicator.
FIG. 10 is a somewhat diagrammatic enlarged perspective view of the second thermistor for the wax applicator, in relation to the normal high elevation and a depleted low elevation of the molten wax.

The roller applicator 20 comprises an electrical circuit 76, shown schematically in FIG. 9, for energizing and controlling the electrical resistance heating element 62. The electrical circuit 76 includes a thermal control device in the bow 26 and connected into the circuit with the heating element 62 for initially supplying full electrical current to the heating element, and subsequently at least partially reducing the electrical current as a thermal response to the attainment of a high wax temperature, sufficient to maintain the wax in a molten state. In FIG. 9, the thermal control device is shown in its preferred form as a thermistor 78, connected in series with the heating element 62 by a junction conductor 80.

The electrical circuit 76 of the roller applicator 20 is adapted to be supplied with electrical power by a conventional power cord 82, adapted to be plugged into a conventional outlet, which most typically supplies alternating current (AC) at 120 volts and 60 Hertz, although the electrical circuit 76 can readily be modified to operate from 240 volts AC. The power cord 82 comprises electrical wires 84 and 86 and is of the plug-in type, so that plug-in connector elements 88 and 90 are employed to connect the wires 84 and 86 to conductors 92 and 94 in the hollow handle 32 of the applicator 20.

A double pole ON-OFF switch 96 is mounted in the hollow handle 32, so as to provide switch elements 98 and 100 for selectively connecting the conductors 92 and 94 to conductors 102 and 104. The series combination of the heating element 62 and the thermistor 78 is connected between the conductors 102 and 104 by plug-in connector elements 106 and 108 and conductors 110 and 112.

As shown in FIGS. 5, 7 and 9, the electrical resistance heating element 62 is in its preferable form, comprising an electrical resistor capable of dissipating adequate wattage to operate on the entire 120 volts of the AC power supply. The wattage of the heating element 68 is sufficient to melt the wax adhesive in a reasonably short time in the bowl 26. Initially, the resistance of the thermistor 78 is quite low, relative to the resistance of the heating element 62, so that the wattage dissipated in the thermistor 78 is correspondingly low. Thus, virtually full voltage and current are initially supplied to the heating element 62 by the thermistor 78.

However, the thermistor 78 is positioned in the bowl 26 for immersion in the molten wax, so that the thermistor 78 is heated by the molten wax as it is melted. The thermistor 78 is chosen to have thermal response characteristics such that the resistance of the thermistor 78 increases rapidly and disproportionately, as the desired high working temperature of the molten wax is achieved. Such working temperature is sufficiently high to maintain the wax in a molten state on the surface of the roller 54. The disproportionately high resistance of the heated thermistor 78 greatly reduces the current in the series combination of the heating element 62 and the thermistor 78 so that the voltage drop across the thermistor 78 increases greatly and approaches the full 120 volts of the AC power supply. The thermistor 78 is capable of withstanding the low wattage dissipated in the thermistor in its heated state. Such wattage and the smaller wattage dissipated in the heating element 62 are conducted to the molten wax and tend to maintain the wax in a molten state, at or near the high working temperature. The working temperature is not so high as to cause discoloration, darkening, scorching or other damage to the wax.

The thermistor 78 operates much in the manner of a thermostatic electronic switch. If the temperature of the molten wax decreases substantially below the desired high working temperature, the resistance of the thermistor 78 decreases abruptly to a much lower value, so that a substantial current again flows in the circuit, to re-energize the electrical resistance heating element 62 sufficiently to again heat the molten wax to the desired high working temperature. The thermistor cycles between its low and high resistance states, to increase and decrease the energization of the heating element 62, so as to maintain the molten wax at or near the desired high working temperature.

As shown in FIGS. 5 and 7, the thermistor 78 is mounted on the heat sink member 64 so that heat is conducted readily between the heat sink member and the thermistor. It will be seen that a recess or bore 114 is formed in the upper side of the heat sink member 64 to receive the thermistor 78, which may be secured in the bore 114 by a suitable adhesive, such as an epoxy potting compound. The adhesive also assists in conducting heat between the heat sink member 64 and the thermistor 78. The bore 114 for receiving the thermistor 78 is close to the channel 66 for receiving the heating element 62, so that the heating element and the thermistor 78 are close together on the heat sink member 64, whereby heat is conducted readily between the heating element and the thermistor.

As shown in FIG. 5, there is an open space or channel 116 alongside the heating element 62 and above the bore 114 in which the thermistor 78 is received. Through such open space 116, the molten wax is able to flow into contact with both the heating element 62 and the thermistor 78. The heat sink member 64 is also formed on its upper side with a rather deep narrow longitudinal channel 118 which bisects the recess or bore 114 for the thermistor 78 and extends to a greater depth than the depth of the bore, whereby the molten wax has access to the thermistor 78 through the channel 118.

As shown in FIG. 7, the thermistor 78 has upper and lower leads or terminal wires 120 and 122. The upper lead 120 is bent laterally and brought out through the open space or channel 116. The lower lead 122 is bent laterally and brought out through the lower portion of the deep narrow longitudinal channel 118.

As shown in FIGS. 5 and 7, a circuit board 124 is mounted on the upper side of the heat sink member 64, to afford printed circuit conductors, to which the heating element 62, the thermistor 78 and other electrical components are connected. The circuit board 124 is made of any suitable electrically insulating material, such as a highly heat resistant resinous plastic material, on which printed circuit conductors are mounted. In this case, a plate 126 is interposed between the circuit board 124 and the upper side of the heat sink member 64. The plate 126 is preferably made of a highly heat conductive metal, such as aluminum. The circuit board 124 and the plate 126 are suitably secured to the heat sink member 64, as by means of a rivet 128, as shown in FIG. 5, whereby the metal plate 126 is clamped against the upper side of the heat sink member 64, and also against the upper side of the electrical resistance heating element 62, the circuit board 124 being clamped against the upper side of the metal plate 126. Thus, the metal plate 126 firmly presses the heating element 62 against the heat sink member 64, while also affording additional heat conduction between the heating element and the heat sink member, and also additional heat conduction to the molten wax. Opposite ends of the metal plate 126 are preferably bent upwardly to form upstanding flanges **126*a* and 126*b* (FIGS. 4, 5 and 7), which assist in melting newly added pieces or bars of wax, inserted into the bowl 26 through the opening 46**.

As shown in the schematic circuit diagram of FIG. 9, a resistor 130 may be connected in parallel with the thermistor 78. Optionally, the resistor 130 may be omitted. The resistor 130, if provided, is mounted on the circuit board 124. The resistor 130 is operative to bypass a small amount of current around the thermistor 78 and through the heating element 62. When the thermistor 78 is in its low resistance state, at room temperature and at relatively low temperatures, the current bypassed by the resistor 130 is insignificant. When the thermistor 78 switches to its high resistance state, due to the attainment of the high working temperature in the molten wax, the resistor 130 bypasses additional keep-warm current around the thermistor 78 and through the heating element 62, so that the heating element tends to maintain the high temperature of the molten wax, with less cycling of the thermistor 78. The wattage dissipated in the resistor 130 also is transferred to the molten wax and tends to maintain the high temperature thereof.

The heating element 62, the heat sink member 64, the thermistor 78, the circuit board 124, the plate 126, the rivet 128 and the other circuit components mounted on the circuit board 124 constitute a bowl heater assembly 132 which is pre-assembled and is slipped into the bowl 26 during the final assembly of the roller applicator 20. Means are provided to retain or hold down the bowl heater assembly 132 in the bowl 26, such means being shown in FIGS. 5 and 7 as comprising a pair of members or posts 134, projecting downwardly from the cover, and having resilient means for resiliently pressing the assembly 132 into the bowl 26. As shown in FIGS. 5 and 7, such resilient means take the form of short lengths of heat resistant rubber or rubberlike tubing 136, slipped over reduced lower ends 138 on the posts 134. The rubber tubing elements 136 function as rubber springs and may be made of heat resistant silicone rubber or other similar materials. In this case, the rubber elements 136 engage the upper side of the circuit board 124 and resiliently press the bowl heater assembly 132 downwardly against the inside of the bowl 26, when the cover 34 is fastened to the bowl 26 by tightening the screw 40. As shown in FIGS. 5 and 7, the posts 134 are preferably molded in one piece with the cover 34.

Figure 3:
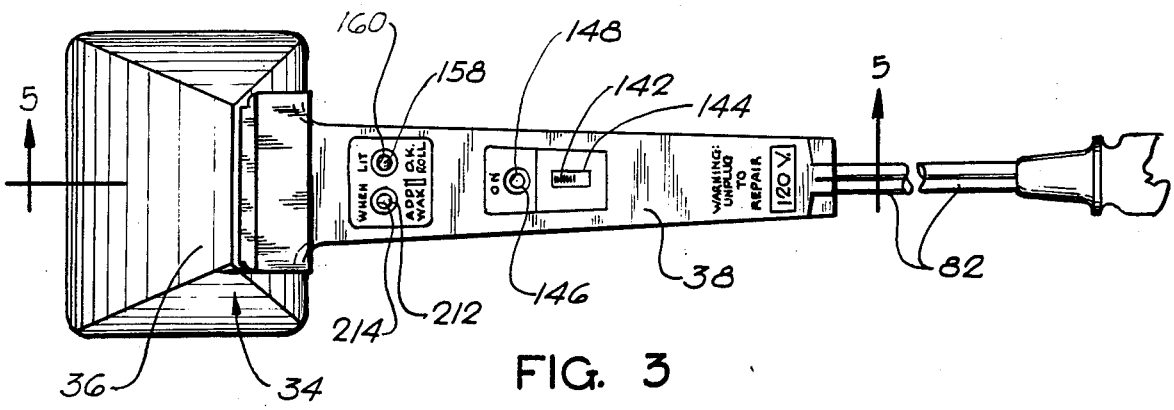
FIG. 3 is a top plan view of the wax applicator.
Figure 8:
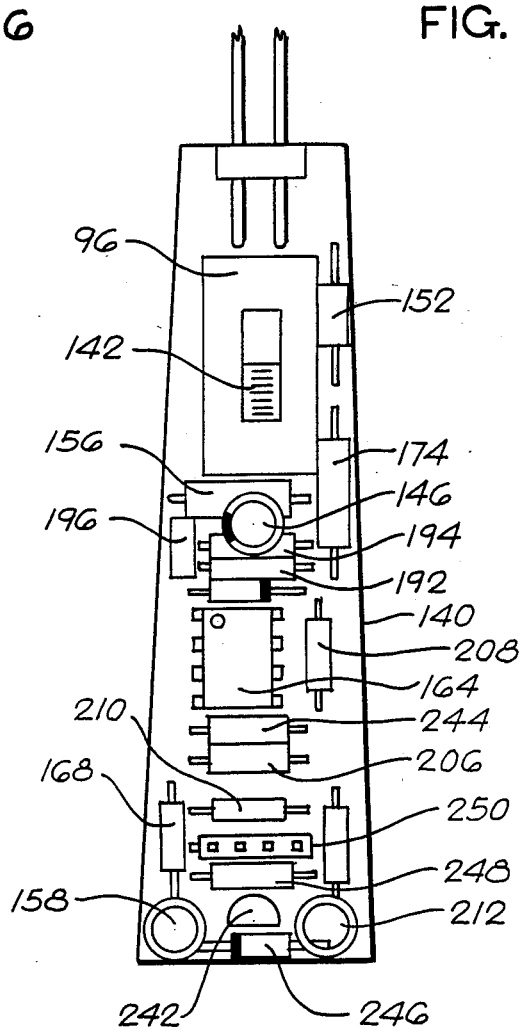
FIG. 8 is a somewhat diagrammatic enlarged top plan view of a circuit board, with various components mounted thereon, such circuit board being adapted to be mounted in the hollow handle of the wax applicator.

The double pole ON-OFF switch 96 is located in the hollow handle 28 and is preferably mounted on a second circuit board 140 which affords numerous printed circuit conductors and is employed to support a number of other electrical circuit components, as shown in FIGS. 4, 5 and 8. The circuit board 140, complete with all of the circuit components mounted thereon, is retained in the hollow handle 28 by the elongated handle portion 38 of the cover 34. The switch 96 has a slidable operating handle 142 which projects upwardly into an accessible position, through a slot 144 in the cover portion 38, as shown in FIGS. 3 and 5.

Indicating means are preferably provided to indicate when the roller applicator 20 is energized with electrical power. Such energization occurs when the power cord 82 is plugged into a live outlet, and the handle 142 of the switch 96 is moved to its ON position, as shown in FIGS. 3 and 5, to close the switch elements 98 and 100. Such indicating means may employ a light emitting device, illustrated as a light emitting diode (LED) 146 in FIGS. 3–5, 8 and 9, The LED 146 is mounted on the circuit board 140, so as to extend into and be visible through an opening 148 in the cover portion 38. The LED 146 may be green in color, or any other desired color.

As shown in FIG. 9, the LED 146 is energized from the AC power conductors 102 and 104 and is connected into a series circuit 150 therebetween, which may be traced to include a rectifying diode 152, a conductor 154, the LED 146 and a current limiting resistor 156. The rectifying diode 152 converts the alternating current power into unidirectional direct current (DC) pulses to energize the LED 146 and other electronic components. The resistor 156 limits the current through the LED 146 to the normal operating range.

The LED 146 is illuminated whenever the power cord 82 is plugged into a live AC outlet, and the switch 96 is operated to its ON or closed position. Rectified half-wave DC pulses appear between the conductor 154 and the conductor 104, for use in energizing other electronic components in the roller applicator 20.

Additional indicator means are preferably provided to indicate when the wax has been melted and heated to its high working temperature by the electrical resistance heating element 62, under the control of the thermistor 78. The applicator 20 is then ready for use. Such indicating means may include an additional light emitting device, illustrated as a second light emitting diode (LED) 158 in FIGS. 3–5, 8 and 9. The LED 158 is mounted on the circuit board 140 so as to extend into and be visible through an opening 160 in the cover portion 38. The LED 158 provides a "ready" light which is labelled O.K. ROLL, on the upper side of the cover portion 38.

The thermistor 78 is a thermal control device for producing a thermal response when the molten wax is heated to its high working temperature by the electrical resistance heating element 62. Such thermal response takes the form of a switching action by the thermistor 78 to a greatly increased electrical resistance, which causes a greatly increased voltage drop across the thermistor, such voltage drop being in the form of an alternating voltage, approaching the full voltage of the AC power supply. The circuitry of the roller applicator 20 preferably includes indicator control means connected to the thermistor 78 for energizing the second LED 158 in response to such greatly increased voltage drop across the thermistor. The indicator control means preferably comprises electronic switching means, illustrated in FIG. 9 as including an operational amplifier 162, which may be one of the two components of a twin amplifier module 164, such module being in the form of an integrated circuit. The amplifier module 164 is mounted on the circuit board 140, as shown in FIG. 8.

As shown in FIG. 9, the operational amplifier 162 has an output terminal or connection 166, from which an output circuit can be traced through a current limiting resistor 168, a conductor 170 and the LED 158, to the voltage supply conductor 104. When the amplifier 162 produces an output, the LED 158 is energized.

Energizing power for the amplifier module 164 is derived by means of a power supply circuit 172, connected between the conductor 154 and the power supply conductor 104. It will be recalled that rectified DC pulses appear at the conductor 154, due to the rectifying action of the diode 152. Such DC pulses are positively polarized, relative to the conductor 104. From the conductor 154 to the conductor 104, the power supply circuit 172 can be traced along a current limiting, voltage dropping resistor 174, a junction conductor 176 and a zener diode 178, which has a clipping action, so that clipped direct current pulses appear at the conductor 176. Such clipped DC pulses have a stable or regulated positive voltage, corresponding to the breakdown voltage of the zener diode 178. Such voltage is suitable for energizing the operational amplifier 162, and also the other amplifier of the twin amplifier module 164. A conductor 180 extends between the junction conductor 176 and the positive power input terminal 182 for the twin amplifier module 164. The power supply conductor 104 is connected to the negative power input terminal 184 of the amplifier module 164.

The operational amplifier 162 has inverting and non-inverting input 186 and 188 which are involved in the desired response to the increased voltage drop across the thermistor 78. The inverting input 186 is preferably supplied with a steady bias voltage which is positively polarized in this instance. Such bias voltage is produced by means forming a bias circuit 190, illustrated as comprising voltage dividing resistors 192 and 194, connected in series between the positive and negative power supply conductors 176 and 104. A filtering capacitor 196 is connected across the resistor 194, between a junction conductor 198 and the power supply conductor 104. Due to the charge storage action of the capacitor 196, a substantially steady bias voltage appears between the junction conductor 198 and the conductor 104, such bias voltage being positively polarized in this instance. The conductor 198 includes portions which are directly connected to the inverting input 186 of the operational amplifier 162, so that the bias voltage serves as a reference voltage for the amplifier 162.

The non-inverting input 188 of the operational amplifier 162 is preferably supplied with a control voltage or signal corresponding to the voltage drop across the thermistor 78. Such control signal is provided by means including a control circuit 200 which can be traced in FIG. 9 from the junction conductor 80 along a rectifier diode 202, a plug-in connector element 204, a resistor 206, a junction conductor 208 and a resistor 210, leading to the power supply conductor 104. A portion of the junction conductor 208 is connected directly to the non-inverting input 188 of the operational amplifier 162. In the control circuit 200, the diode 202 acts as a half-wave rectifier to supply positively polarized DC pulses, corresponding to the voltage drop across the thermistor 78. The resistors 206 and 210 act as a voltage divider, to reduce the voltage of the DC pulses to a level suitable for use at the non-inverting input of the operational amplifier 162. Initially, when the thermistor 78 is at room temperature, the resistance of the thermistor is very low, and the voltage drop across the thermistor 78 is correspondingly low. The positively polarized DC pulses supplied to the input 188 of the operational amplifier are at a very low voltage, much less than the positive bias voltage supplied to the input 186. When the heating element 62 melts the wax and heats the molten wax to its high working temperature, the thermistor 78 switches to its disproportionately high resistance, so that the voltage drop across the thermistor 78 becomes correspondingly high. The positively polarized DC pulses supplied to the non-inverting input 188 of the operational amplifier 162 are correspondingly increased in voltage, so that they substantially exceed the bias or reference voltage at the inverting input 186. As a result, the operational amplifier 162 produces a positive output current which energizes the LED 158, to indicate that the roller applicator 20 is ready for use by the operator. Thus, the operator can apply the wax adhesive 22 to any desired surface, by roller the applicator roller 54 along such surface.

The thermally responsive transition of the thermistor 78, between its low resistance state and its high resistance state, is rather abrupt. As soon as the voltage pulses at the input 188 exceed the bias voltage at the input 186, the operational amplifier 162 is abruptly switched to produce a positive output current for energizing the LED 158.

The wax in the bowl 26 gradually becomes depleted as the roller applicator 20 is used over a period of time to apply the wax to various surfaces. The level of the molten wax in the bowl 26 eventually drops to a low level such that more wax should be added to the bowl 26. Preferably, the applicator 20 comprises low wax level indicating means, including an indicator device, illustrated in FIGS. 4, 8 and 9 as a third light emitting diode (LED) 212. Preferably, the three LED's 146, 158 and 212 should have distinctive colors, such as green, red and yellow, respectively. As shown in FIGS. 3, 4 and 8, the LED 212 is mounted on the circuit board 140 and extends upwardly into an opening 214 in the cover portion 38 so as to be visible through such opening. In relation to the LED 212, the cover portion 38 is marked with a legend which reads "WHEN LIT ADD WAX".

In order to energize the LED 212 as an indication of low wax level in the bowl 26, the roller applicator 20 preferably comprises a second thermal control device, illustrated in FIGS. 4, 7, 9 and 10 as a second thermistor 216, positioned in the bowl 26 at a level to establish the minimum desired molten wax level. As shown in FIGS. 4 and 7, the second thermistor 216 is mounted on the circuit board 124 and is positioned near the underside of the circuit board, opposite an opening 218 therein. The second thermistor 216 is also spaced from the heat sink member 64, so that the molten wax is free to rise, fall and circulate freely around the second thermistor. Preferably, the second thermistor is at a somewhat higher elevation than the elevation of the first thermistor 78.

When there is an adequate supply of wax in the bowl 26, the second thermistor 216 is fully immersed in the molten wax. FIG. 10 shows the molten wax 220 in full lines at a high level, sufficient to immerse the second thermistor 216 fully. For this condition, the molten wax 220 has a high heat transfer to the thermistor 216, so that the thermistor is heated to substantially the high temperature of the molten wax. Under such conditions of high temperature, the thermistor 216 is in its high resistance state, disproportionately higher than the low resistance of the thermistor at lower temperatures. As the wax 220 is depleted by ordinary use of the roller applicator 20, the level of the wax drops in the bowl 26, so that the second thermistor 216 is only partly immersed in the molten wax. The degree of immersion decreases, until eventually the thermistor 216 is not immersed at all, but is above the low level of the wax, as indicated diagrammatically in broken lines in FIG. 10. As the degree of immersion decreases, the heat transfer between the molten wax and the thermistor 216 decreases, so that the temperature of the thermistor also decreases. The decrease in the temperature of the thermistor 216 causes a transition in the electrical resistance of the thermistor, between its high resistance state and a substantially lower resistance. This transition is progressive, but rather abrupt. In the roller applicator 20, the downward transition of the resistance is employed to produce an electrical change, so as to energize the LED 212, which signals to the operator that wax needs to be added to the bowl 26.

As shown in FIG. 9, the second thermistor 216 is connected into an electrical control circuit 222, for translating the change in the resistance of the thermistor 216 into a change in electrical signals, which in turn are employed to cause energization of the LED 212. In FIG. 9, one end terminal of the thermistor 216 is connected to the conductor 112, which, as previously described, is connected by a plug-in connector element 108 to the DC power supply conductor 104. The other end terminal of the thermistor 216 is connected by another plug-in connector element 224 to a conductor 226. A resistor 228 is connected between the conductor 226 and the previously described conductor 180. As previously indicated, the power supply circuit 172 supplies the conductor 180 with clipped positively polarized DC pulses, having a magnitude determined by the breakdown voltage of the zener diode 178. These pulses are employed to energize the second thermistor 216, through the current limiting resistor 228. When the thermistor 216 is in its high resistance state, positive pulses appear on the conductor 226 at a relatively high voltage level. When the thermistor cools sufficiently to cause its transition to a low resistance state, the DC pulses on the conductor 226 decrease progressively to a substantially lower voltage level.

The control circuit 222 also preferably comprises electronic switching means, illustrated in FIG. 9 as an operational amplifier 230, constituting the second amplifier of the twin module or integrated circuit 164. The operational amplifier 230 has an inverting input 232, connected to the conductor 226, and a noninverting input 234, connected to the bias supply conductor 198, on which a positive bias voltage appears, as previously described. The operational amplifier 230 has an output terminal 236, from which a current limiting resistor 238 and the LED 212 are connected in series to a conductor 240. To provide additional electronic switching means, for a purpose to be described presently, a transistor 242 is connected between the conductor 240 and the power supply conductor 104. The conductor 240 is connected to the collector of the transistor 242. The emitter of the transistor 242 is connected to the power supply conductor 104. The conductor 240 is also supplied with the biasing voltage by the series combination of a resistor 244 and a rectifier diode 246, connected between the bias supply conductor 180 and the conductor 240. The base of the transistor 242 is connected through a current limiting resistor 248 to the conductor 170 in the output circuit of the first operational amplifier 162. As previously described, the second LED 158 is connected between the conductor 170 and the power supply conductor 104.

The additional electronic switching action of the transistor 242 prevents any energization of the third LED 212 until the wax is melted by the electrical heating element 62 and is heated to its high working temperature, so as to cause the transition of the first thermistor 78 to its high resistance state. Until this transition occurs, the first operational amplifier 162 does not supply any positive output voltage to the conductor 170, with the result that the transistor 242 is maintained in a nonconductive state. Consequently, no current can flow through the third LED 212, which is connected in series with the transistor 242. The collector of the transistor 242 is supplied with the positive biasing voltage from the conductor 198 by the resistor 244 and the diode 246, so that the transistor 242 remains nonconductive until the first operational amplifier 162 develops a positive output voltage on the conductor 170, exceeding the bias voltage. When the first thermistor 78 is heated sufficiently to make its transition to its high resistance state, the increased voltage drop across the thermistor 78 causes the first operational amplifier 162 to supply a positive output voltage which is sufficient to energize the second LED 158, and is also sufficient to switch the transistor 242 to a conductive state. In this way, the energization of the third LED 212 is enabled.

However, the actual energization of the third LED 212 is produced by the second operational amplifier 230, when the second thermistor 216 cools down sufficiently, due to a low wax level, to cause the thermistor 216 to make its transition to a low resistance state.

Initially, from a cold start, the energization of the low wax LED 212 is disabled or inhibited by the nonconductivity of the transistor 242. When the wax is melted and is heated to its high working temperature by the electrical heating element 62, the first thermistor makes its transition to a high resistance state, thus causing the first operational amplifier 162 to produce a positive output which is applied to the base of the transistor 242, so that it is rendered conductive, Thus, the energization of the LED 212 is enabled. However, if the wax level is high, the second thermistor 216 is heated to the high wax temperature, so that the second thermistor also makes its transition to its high resistance state, so that positive pulses of a relatively high voltage are developed across the thermistor 216 and on the conductor 226 and the inverting input 232 of the second operational amplifier 230, so that any positive output of the second operational amplifier 230 is inhibited. The positive pulses at the inverting input 232 offset the positive bias voltage at the non-inverting input. Moreover, the positive bias on the output conductor 240 inhibits the energization of the low wax LED 212.

When a low wax condition begins to develop, due to the depletion of the wax during normal use of the roller applicator 20, the degree of immersion of the second thermistor 216 in the molten wax is decreased, so that the second thermistor starts to cool down. The second thermistor starts to make its transition to its low resistance state, thereby decreasing the magnitude of the positive pulses on the inverting input 232 of the amplifier 230. As the positive pulses decrease, the output duty cycle of the operational amplifier 230 increases, so that the LED 212 emits light, dimly at first and then more brightly as the wax is gradually depleted. When the thermistor 216 is cooled sufficiently to complete its transition to its low resistance state, the positive pulses on the inverting input 232 drop to a low level, so that the positive bias voltage on the non-inverting input 234 causes the second operational amplifier 230 to deliver its maximum positive output to the low wax LED 212, so that it is energized to its full brilliance, to indicate that there is a definite and urgent need to add wax to the bowl 26 of the roller applicator 20.

Thus, when the low wax LED 212 becomes noticeably but dimly lighted, the operator knows that the wax is becoming depleted and that more wax should be added to the bowl 26. When the LED 212 becomes brightly lighted, the operator knows that the wax level is particularly low, and that there is an urgent need to add more wax to the bowl 26.

As shown in FIG. 9, the bowl heater assembly 132 includes the electrical resistance heating element 62, the first thermistor 78, the resistor 130, if used, the diode 202 and the second thermistor 216, all of which are mounted on the circuit board 124. As previously described, the bowl heater assembly 132 is removably mounted in the bowl 26.

All of the other circuit components shown in FIG. 9 are mounted on the circuit board 140, which is removably mounted in the hollow handle 28. The plug-together connector elements 106, 108, 204 and 224 make it possible to unplug the bowl heater assembly 132 from the circuit board 140, so that the assembly and maintenance of the roller applicator 20 are facilitated. The four connecting elements 106, 108, 204 and 224 are illustrated as components of a connector set, comprising a four-prong plug 250, on the circuit board 140, as shown in FIG. 8, and a mating receptacle 252, shown in FIGS. 4 and 5, connected to the circuit board 124 by four flexible insulated wires 254, 256, 258 and 260, which extend between the bowl 26 and the hollow handle 28. The four wires are fitted into a sealed joint 262 (FIG. 7) between wall portions 264 and 266 of the cover 34 and the one-piece body 268, consisting of the bowl 26 and the hollow handle 28. The four wires 254, 256, 258 and 260 are tightly fitted into notches or slots 270, formed in the upper edge of the wall portion 266, and having semicircular, upwardly concave lower edges. The four wires are compressed into the notches 270 by flanges or tongues 272, projecting downwardly from the wall portion 264, and having semicircular, downwardly concave lower edges. This sealed joint construction prevents any leakage of molten wax between the bowl 26 and the hollow handle 28, in which the electronic circuit board 140 is contained. As shown in FIG. 5, the cover 34 has a downwardly projecting hollow channel-shaped flange 274, extending downwardly into the bowl 26, to protect the four flexible wires.

Figure 11:
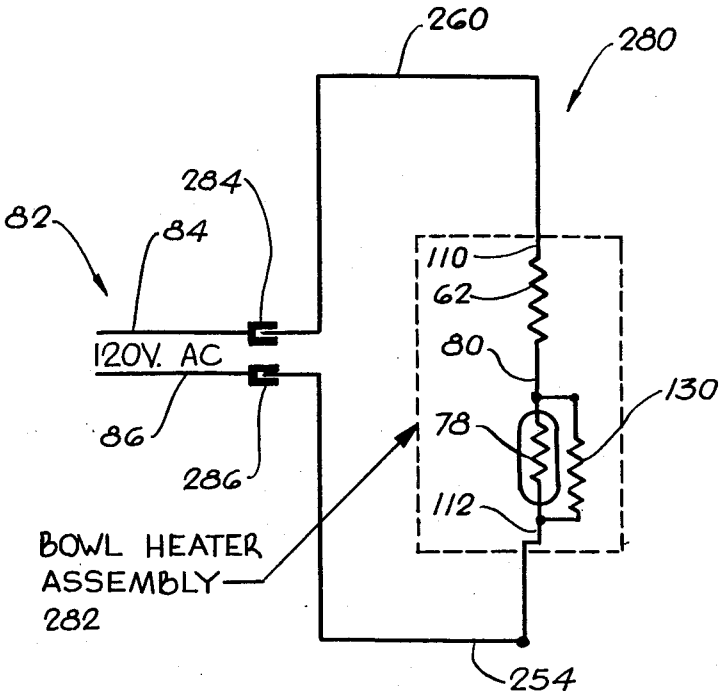
FIG. 11 is a schematic circuit diagram of a modified wax applicator.

FIG. 11 is a schematic circuit diagram of a modified roller applicator 280, to be described as another illustrative embodiment of the present invention. The modified roller applicator 280 has the advantage of being somewhat simplified and adapted to be produced and sold at a lower cost, while still retaining some of the most important features of the previously described roller applicator 20 of FIGS. 1–10. Except for the differences to be described with reference to FIG. 11, the modified roller applicator 280 is preferably the same in construction as the previously described roller applicator 20. Mechanically, the modified roller applicator 280 may be essentially the same as described and illustrated in connection with FIGS. 1–7.

However, the electrical construction of the modified roller applicator 280 is considerably simplified. It will seen from FIG. 11 that the electrical circuit for the modified roller applicator 280 comprises the electrical resistance heating element 62, connected in series with the thermistor 78, and also in series with the conductors 80, 110 and 112, as previously described. The optional resistor 130 is connected in parallel with the thermistor 78, as described previously. All of these electrical components are mounted on a modified bowl heater assembly 282, which is the same as the previously described bowl heater assembly 132, except that all of the other electrical components are omitted. Thus, the omitted components include the second thermistor 216 and the rectifier diode 202. The electrical resistance heating element 62 and the thermistor 78 are connected to and mounted on the printed circuit board 140, the same as before. The conductors 80, 110 and 112 are on the circuit board 140. In all other respects, the bowl heater assembly 282 is the same as the bowl heater assembly 132.

Only the two connecting wires 254 and 260 are required, in the electrical circuit of FIG. 11, to supply AC electrical power to the bowl heater assembly 282. The wires 254 and 260 are connected to the conductors 112 and 110, respectively. Plug-in connector elements 284 and 286 are provided to connect the respective electrical wires 84 and 86 of the AC power cord 82 directly to the respective wires 260 and 254. In the modified roller applicator 280, the entire circuit board 140 and all of the electrical and electronic components mounted thereon are omitted. In particular, the switch 96, the switch operating handle 142, and the three light emitting diodes 146, 158 and 212 are omitted, as are the associated openings 144, 160 and 214 in the handle portion 38 of the cover 34. The legends associated with the light emitting diodes are not needed and are omitted.

Initially, the modified roller applicator 280 is energized by plugging the power cord 82 into an alternating current power line at 120 volts, or any other suitable voltage, for which the roller applicator 280 is designed. With a cold start, the thermistor 78 is in its low resistance state, so that full energizing current is supplied to the electrical resistance heating element 62, so that it heats and quickly melts the wax in the bowl 26 of the roller applicator 280. When the molten wax heats the thermistor 78 to its characteristic switchover temperature, the thermistor 78 changes to its high resistance state, so that the electrical current through the thermistor 78 and the resistance heating element 62 is greatly reduced, to a minimal value. A keep-warm current is bypassed around the thermistor 78 and through the resistance heating element 62 by the resistor 130, the resistance of which determines the magnitude of the keep-warm current. The resistor 130 reduces the cycling of the thermistor 78 and maintains the molten wax at a steadier temperature. When it is desired to shut down or de-energize the roller applicator 280, the power cord 82 is unplugged from the alternating current power line.

The modified roller applicator 280 has the advantage that the wax is quickly melted, by the high wattage of the resistance heating element 62, while the molten wax is protected from overheating by the automatic switching action of the thermistor 78. The molten wax is maintained at a rather steady operating temperature. The wax is not scorched, discolored or otherwise damaged, because the thermistor 78 prevents any overheating of the molten wax.

Those skilled in the art will be able to assign appropriate component values and type numbers or other type designations to the various components of the roller applicators 20 and 280. Moreover, the component values and the type designations are subject to considerable variations by those skilled in the art, to suit various operating conditions. However, it may be helpful to list a particular set of component values and type numbers, which have been found to be satisfactory in actual testing of an embodiment of the present invention, to enable those skilled in the art to practice the invention with greater facility. Consequently, the following list of component values and type numbers is being included herein, with the understanding that the list should not be construed as limiting the invention, but rather is being submitted by way of example, inasmuch as the component values and type numbers may be widely varied, within the scope of the present invention:

List of Component Values and Type Numbers

| Resistors | Values in ohms |
|---|---|
| 62 | 620 |
| 130 | 3,000 approximately |
| 156 | 10 K |
| 168 | 30.0 K |
| 174 | 6.2 K |
| 192 | 100 K |
| 194 | 32.4 K |
| 206 | 100 K |
| 210 | 14 K |
| 228 | 200 K |
| 238 | 3.0 K |
| 244 | 1 K |
| 248 | 5.1 K |
| Capacitor | Value in microfarads |
| 196 | 47 |
| Diodes | Type Numbers |
| 152 | 1N4005 |
| 202 | 1N4005 |
| 246 | 1N4148 |
| Dual Operational Amplifier Module | Type Number |
| 164 | LM358/LM2904 |
| Zener Diode | Type Number and Characteristics |
| 178 | 1N969B 22 volts approx. |
| Transistor | Type Number |
| 242 | PN2222A |
| Light Emitting Diodes | Type Numbers |
| 146 | Stanley ESBG5701 |
| 158 | Stanley ESBR5701 |
| 212 | Stanley ESBY5701 |
| Thermistors | Type Numbers |
| 78 | MEPCO/ELECTRA 662-91022 |
| 216 | MEPCO/ELECTRA 672-91022 |

The main thermistor 78 may have a cold resistance of approximately 45 ohms and a rated switch temperature of approximately 115° C. (239° F.). At higher temperatures, the resistance of the thermistor 78 increases at a high rate to a disproportionately high value, such that the combined heating action of the electrical resistance heating element 62 and the thermistor 78 is greatly reduced. Due to heat losses, the temperature of the heat sink member 64 is maintained at a somewhat lower operating level of approximately 215° F. (102° C.). The applicator roller 54 may be maintained at about 170–180° F. (77–82° C.).

The thermistor 216, employed for low wax indication, may have a cold resistance of approximately 90 ohms. At the high working temperature of the molten wax, the thermistor 216 has a disproportionately higher resistance.

The resistance value of the resistor 130, which is shunted across the main thermistor 78, may be varied, to suit the characteristics of the thermistor 78, so as to adjust the temperature regulating action of the thermistor 78. When the thermistor 78 is heated sufficiently to switch to its high resistance state, the resistor 130 bypasses electrical current around the thermistor 78 and through the heating resistor 62, to afford a keep-warm action, whereby the cycling of the thermistor 78 is reduced.

The roller applicators 20 and 280 have been tested very successfully for use with microcrystalline wax adhesive material, but the roller applicators can be used to good advantage with many other meltable materials.

I claim:

1. A wax applicator for applying molten wax to a desired surface, the applicator comprising a body including a bowl for receiving wax to be melted and maintained in a molten state, an applicator roller for receiving the molten wax from the bowl and applying the wax to the desired surface, the bowl having a lower portion with an opening therein through which the wax flows from the bowl to the roller, means for rotatably mounting the roller on the lower portion with the roller forming a closure for the opening, an electrical resistance heating element positioned in the bowl for immersion in the wax and for melting the wax and maintaining the wax in a molten state, and an electrical circuit for energizing and controlling the heating element, the circuit including a thermistor positioned in the bowl for immersion in the wax and connected in the circuit directly in series with the heating element for initially supplying full electrical current through the thermistor to the heating element and subsequently partially reducing the electrical current as a thermal response to a high wax temperature sufficient to maintain the wax in a molten state, the thermistor having a low electrical resistance at room temperatures and making a transition to a disproportionately higher electrical resistance at the high wax temperature for greatly reducing the electrical current supplied through the thermistor to the heating element, and means for supplying electrical line power to the circuit.

2. A wax applicator for applying molten wax to a desired surface, the applicator comprising a body including a bowl for receiving wax to be melted and maintained in a molten state, an applicator roller for receiving the molten wax from the bowl and applying the wax to the desired surface, the bowl having a lower portion with an opening therein through which the wax flows from the bowl to the roller, means for rotatably mounting the roller on the lower portion with the roller forming a closure for the opening, an electrical resistance heating element positioned in the bowl for immersion in the wax and for melting the wax and maintaining the wax in a molten state, and an electrical circuit for energizing and controlling the heating element, the circuit including a thermistor positioned in the bowl for immersion in the wax and connected in the circuit in series with the heating element for initially supplying full electrical current to the heating element and subsequently at least partially reducing the electrical current as a thermal response to a high wax temperature sufficient to maintain the wax in a molten state, the thermistor having a low electrical resistance at room temperatures and a disproportionately higher electrical resistance at the high wax temperature for greatly reducing the electrical current supplied to the heating element, AC power supply means for supplying alternating current electrical line power to the circuit, the circuit having a junction between the heating element and the thermistor at which junction there is a substantial change in AC voltage in response to the thermal response of the thermistor, a light emitting diode,.

electronic control means connected to the thermistor for energizing the light emitting diode in response to the thermal response of the thermistor, first rectifier means connected to the AC power supply means for supplying rectified direct current operating voltage to the electronic control means, and second rectifier means connected to the junction between the heating element and the thermistor for supplying rectified direct current input signals to the electronic control means for causing the electronic control means to energize the light emitting diode as a ready light in response to the thermal response of the thermistor.

3. A wax applicator according to claim 2, the electronic control means comprising an operational amplifier having an output connected to the light emitting diode, the operational amplifier having means for receiving rectified direct current operating voltage from the first rectifier means, and an input with means for receiving the rectified direct current input signals from the second rectifier means to cause energization of the light emitting diode.

4. A wax applicator for applying molten wax to a desired surface, the applicator comprising a body including a bowl for receiving wax to be melted and maintained in a molten state, an applicator roller for receiving the molten wax from the bowl and applying the wax to the desired surface, the bowl having a lower portion with an opening therein through which the wax flows from the bowl to the roller, means for rotatably mounting the roller on the lower portion with the roller forming a closure for the opening, an electrical resistance heating element for melting the wax in the bowl and maintaining the wax in a molten state, a first electrical circuit for energizing and controlling the heating element, the first circuit including a first thermal control device in the bowl and connected in the first circuit with the heating element for initially supplying full electrical current to the heating element and subsequently at least partially reducing the electrical current as a thermal response to a high wax temperature sufficient to maintain the wax in a molten state, a first light emitting indicator device, first indicator control means connected to the thermal control device for energizing the first indicator device in response to the thermal response of the first thermal control device, the heating element and the first thermal control device being positioned in the bowl for immersion in the molten wax, a second thermal control device positioned in the bowl at a level to establish the minimum desired molten wax level, the second thermal control device being subjected to the high wax temperature when immersed in the molten wax while being subjected to a lower temperature when not fully immersed in the molten wax, the second thermal control device producing an electrical change in response to the lower temperature, a second light emitting indicator device, and a second electrical control circuit including second indicator control means connected between the second thermal control device and the second light emitting indicator device for energizing the second light emitting indicator device in response to the electrical change of the second thermal control device, whereby the second light emitting indicator device shows that wax should be added to the bowl to maintain the minimum desired molten wax level, said wax applicator including third control means forming a control connection between the first thermal control device and the second light emitting indicator device for initially disabling the energization of the second light emitting indicator device and subsequently enabling the energization thereof in response to the thermal response of the first thermal control device produced by the high wax temperature.

5. A wax applicator according to claim 4, in which the third control means includes an electronic switching device connected to the second light emitting indicator device for initially disabling the energization thereof, the electronic switching device having an input connected to the first thermal control device for subsequently causing the electronic switching device to enable the energization of the second light emitting indicator device in response to the thermal response of the first thermal control device produced by the high wax temperature.

6. A wax applicator according to claim 4, in which the third control means includes a transistor connected to the second light emitting indicator device for initially disabling the energization thereof, the transistor having an input connected to the first thermal control device for subsequently causing the transistor to enable the energization of the second light emitting indicator device in response to the thermal response of the first thermal control device produced by the high wax temperature.

7. A wax applicator according to claim 4, in which the third control means includes a transistor connected in series with the second light emitting indicator device for initially disabling the energization thereof, the transistor having an input connected to the first thermal control device for subsequently causing the transistor to enable the energization of the second light emitting indicator device in response to the thermal response of the first thermal control device produced by the high wax temperature.

8. A wax applicator for applying molten wax to a desired surface, the applicator comprising a body including a bowl for receiving wax to be melted and maintained in a molten state, an applicator roller for receiving the molten wax from the bowl and applying the wax to the desired surface, the bowl having a lower portion with an opening therein through which the wax flows from the bowl to the roller, means for rotatably mounting the roller on the lower portion with the roller forming a closure for the opening, an electrical resistance heating element for melting the wax in the bowl and maintaining the wax in a molten state, a first electrical circuit for energizing and controlling the heating element, the first circuit including a first thermal control device in the bowl and connected in the first circuit with the heating element for initially supplying full electrical current to the heating element and subsequently at least partially reducing the electrical current as a thermal response to a high wax temperature sufficient to maintain the wax in a molten state, a first light emitting indicator device, first indicator control means connected to the thermal control device for energizing the first indicator device in response to the thermal response of the first thermal control device, the heating element and the first thermal control device being positioned in the bowl for immersion in the molten wax, a second thermal control device positioned in the bowl at a level to establish the minimum desired molten wax level, the second thermal control device being subjected to the high wax temperature when immersed in the molten wax while being subjected to a lower temperature when not fully immersed in the molten wax, the second thermal control device producing an electrical change in response to the lower temperature, a second light emitting indicator device, and a second electrical control circuit including second indicator control means connected between the second thermal control device and the second light emitting indicator device for energizing the second light emitting indicator device in response to the electrical change of the second thermal control device, whereby the second light emitting indicator device shows that wax should be added to the bowl to maintain the minimum desired molten wax level, the first thermal control device comprising a first thermistor having a low electrical resistance at room temperatures and a disproportionately higher electrical resistance at the high wax temperature for greatly reducing the electrical current supplied to the heating element, the first electrical circuit including means for connecting the first thermistor in series with the heating element, and means for supplying electrical voltage to the first electrical circuit, whereby a greatly increased voltage drop is produced across the first thermistor by its thermal response to the high wax temperature, the first indicator control means being operable in response to the greatly increased voltage drop for energizing the first indicator device, the second thermal control device comprising a second thermistor having a sharply lower electrical resistance at the lower temperature when not fully immersed in the molten wax than at the high wax temperature, the second indicator control means including means for translating the sharply lower electrical resistance to a changed electrical signal, and means responsive to the changed electrical signal for energizing the second light emitting indicator device, the first light emitting indicator device comprising a first light emitting diode, the first indicator control means comprising first electronic switching means for energizing the first light emitting diode in response to the greatly increased voltage drop, the second light emitting indicator device comprising a second light emitting diode, the second indicator control means comprising second electronic switching means for energizing the second light emitting diode in response to the changed electrical signal, the wax applicator including third control means forming a control link between the first thermistor and the second light emitting diode for initially disabling the energization of the second light emitting diode and subsequently enabling the energization thereof in response to the greatly increased voltage drop produced across the first thermistor by the high wax temperature.

9. A wax applicator according to claim 8, the third control means comprising a third electronic switching device having first and second control connections to the first thermistor and the second electronic switching device.

10. A wax applicator according to claim 9, in which the third electronic switching device comprises a transistor having first and second inputs connected to the first and second control connections.

11. A wax applicator for applying molten wax to a desired surface, the applicator comprising a body including a bowl for receiving wax to be melted and maintained in a molten state, an applicator roller for receiving the molten wax from the bowl and applying the wax to the desired surface, the bowl having a lower portion with an opening therein through which the wax flows from the bowl to the roller, means for rotatably mounting the roller on the lower portion with the roller forming a closure for the opening, an electrical resistance heating element for melting the wax in the bowl and maintaining the wax in a molten state, a first electrical circuit for energizing and controlling the heating element, the first circuit including a first thermal control device in the bowl and connected in the first circuit with the heating element for initially supplying full electrical current to the heating element and subsequently at least partially reducing the electrical current as a thermal response to a high wax temperature sufficient to maintain the wax in a molten state, a first light emitting indicator device, first indicator control means connected to the thermal control device for energizing the first indicator device in response to the thermal response of the first thermal control device, the heating element and the first thermal control device being positioned in the bowl for immersion in the molten wax, a second thermal control device positioned in the bowl at a level to establish the minimum desired molten wax level, the second thermal control device being subjected to the high wax temperature when immersed in the molten wax while being subjected to a lower temperature when not fully immersed in the molten wax, the second thermal control device producing an electrical change in response to the lower temperature, a second light emitting indicator device, and a second electrical control circuit including second indicator control means connected between the second thermal control device and the second light emitting indicator device for energizing the second light emitting indicator device in response to the electrical change of the second thermal control device, whereby the second light emitting indicator device shows that wax should be added to the bowl to maintain the minimum desired molten wax level, the first thermal control device comprising a first thermistor having a low electrical resistance at room temperatures and a disproportionately higher electrical resistance at the high wax temperature for greatly reducing the electrical current supplied to the heating element, the first electrical circuit including means for connecting the first thermistor in series with the heating element, and means for supplying electrical voltage to the first electrical circuit, whereby a greatly increased voltage drop is produced across the first thermistor by its thermal response to the high wax temperature, the first indicator control means being operable in response to the greatly increased voltage drop for energizing the first indicator device, the second thermal control device comprising a second thermistor having a sharply lower electrical resistance at the lower temperature when not fully immersed in the molten wax than at the high wax temperature, the second indicator control means including means for translating the sharply lower electrical resistance to a changed electrical signal, and means responsive to the changed electrical signal for energizing the second light emitting indicator device, the first light emitting indicator device comprising a first light emitting diode, the first indicator control means comprising a first operational amplifier for energizing the first light emitting diode in response to the greatly increased voltage drop, the second light emitting indicator device comprising a second light emitting diode, the second indicator control means comprising a second operational amplifier for energizing the second light emitting diode in response to the changed electrical signal, the wax applicator including bias source means for producing a substantially steady unidirectional bias voltage, the first operational amplifier having a first bias input for receiving the bias voltage, the first operational amplifier having a first control input with first control link means to the first thermistor, the second operational amplifier having a second bias input for receiving the bias voltage, the second operational amplifier having a second control input with second control link means to the second thermistor, the wax applicator including third control means comprising a transistor, the second operational amplifier having an output circuit including the second light emitting diode and the transistor, the transistor having an input circuit connected to the first thermistor for initially disabling the energization of the second light emitting diode and subsequently enabling the energization thereof in response to the greatly increased voltage drop produced across the first thermistor by the high wax temperature, the actual energization of the second light emitting diode being produced by the second operational amplifier in response to the changed electrical signal produced when the second thermistor is not fully immersed in the molten wax.

12. A wax applicator for applying molten wax to a desired surface, the applicator comprising a body including a bowl for receiving wax to be melted and maintained in a molten state, an applicator roller for receiving the molten wax from the bowl and applying the wax to the desired surface, the bowl having a lower portion with an opening therein through which the wax flows from the bowl to the roller, means for rotatably mounting the roller on the lower portion with the roller forming a closure for the opening, an electrical resistance heating element positioned in the bowl for immersion in the wax and for melting the wax and maintaining the wax in a molten state, and an electrical circuit for energizing and controlling the heating element, the circuit including a thermistor positioned in the bowl for immersion in the wax and connected in the circuit directly in series with the heating element for initially supplying full electrical current through the thermistor to the heating element and subsequently partially reducing the electrical current as a thermal response to a high wax temperature sufficient to maintain the wax in a molten state, the thermistor having a low electrical resistance at room temperatures and making a transition to a disproportionately higher electrical resistance at the high wax temperature for greatly reducing the electrical current supplied through the thermistor to the heating element, and means for supplying electrical line power to the circuit, the circuit also including a bypassing resistor connected in parallel with the thermistor for bypassing a small current around the thermistor and through the heating element for maintaining the high wax temperature while minimizing cycling of the thermistor, the bypassing resistor having a high value of resistance compared with the low electrical resistance of the thermistor at room temperatures.

13. A wax applicator according to claim 12, the bypassing resistor having a high value of resistance compared with the electrical resistance of the heating element.

14. A wax applicator according to claim 12, including common supporting means for supporting the electrical resistance heating element, the thermistor and the bypassing resistor in the bowl for immersion in the molten wax for direct heat transfer therewith.

15. A wax applicator for applying molten wax to a desired surface, the applicator comprising a body including a bowl for receiving wax to be melted and maintained in a molten state, an applicator roller for receiving the molten wax from the bowl and applying the wax to the desired surface, the bowl having a lower portion with an opening therein through which the wax flows from the bowl to the roller, means for rotatably mounting the roller on the lower portion with the roller forming a closure for the opening, an electrical resistance heating element positioned in the bowl for immersion in the wax and for melting the wax and maintaining the wax in a molten state, and an electrical circuit for energizing and controlling the heating element, the circuit including a thermistor positioned in the bowl for immersion in the wax and connected in the circuit directly in series with the heating element for initially supplying full electrical current through the thermistor to the heating element and subsequently partially reducing the electrical current as a thermal response to a high wax temperature sufficient to maintain the wax in a molten state, the thermistor having a low electrical resistance at room temperatures and making a transition to a disproportionately higher electrical resistance at the high wax temperature for greatly reducing the electrical current supplied through the thermistor to the heating element, and means for supplying electrical line power to the circuit, the applicator comprising common supporting means for supporting the electrical resistance heating element and the thermistor in the bowl for immersion in the molten wax for direct heat transfer therewith.

* * * * *